United States Patent [19]

Havens et al.

[11] Patent Number: 5,044,330

[45] Date of Patent: Sep. 3, 1991

[54] VALVE SPRING SPACER

[76] Inventors: Elwood L. Havens; Mazy C. Havens, both of 20700 Country Oaks Dr. #43, Riverview, Mich. 48192

[21] Appl. No.: 548,853

[22] Filed: Jul. 6, 1990

[51] Int. Cl.[5] ..... F01L 3/10

[52] U.S. Cl. ..... 123/90.67

[58] Field of Search ..... 123/90.65, 90.66, 90.67

[56] References Cited

U.S. PATENT DOCUMENTS

| | | | |
|---|---|---|---|
| 2,868,188 | 1/1959 | Havens | 123/90.67 |
| 2,935,979 | 5/1960 | Havens | 123/90.69 |
| 3,179,094 | 4/1965 | Ribeton | 123/90.65 |
| 3,563,218 | 2/1971 | Havens | 123/90.67 |
| 4,470,383 | 9/1984 | DeBolt | 123/90.65 |

FOREIGN PATENT DOCUMENTS

| | | | |
|---|---|---|---|
| 0217711 | 12/1983 | Japan | 123/90.65 |

*Primary Examiner*—David A. Okonsky
*Assistant Examiner*—Weilun Lo
*Attorney, Agent, or Firm*—Barnes, Kisselle, Raisch, Choate, Whittemore & Hulbert

[57] ABSTRACT

A valve spring spacer for internal combustion engines formed from a ring of metal in a stamping operation. The ring has an open center and each side of the ring has alternate raised radial ribs separated by grooves. A radial rib on one side of the ring is axially opposed to a groove on the other side of the ring to allow cooling and reduce heat transmission to the valve spring.

1 Claim, 1 Drawing Sheet

VALVE SPRING SPACER

FIELD OF INVENTION

In internal combustion engines, fuel inlet and exhaust valves with spring return and spacers below the springs to compensate for wear and increase spring tension.

BACKGROUND OF INVENTION

Frequently, it is desirable to increase the tension of a valve spring in an automotive engine by inserting a shim or spacer of certain thickness dimension between the spring and the block.

It is an object of the invention to provide a valve spacer unit which compensates for spring wear in the block and on the spring cap and also on the spring ends.

It is also an object to provide a device which can compensate for loss of spring tension due to torsional relaxation resulting from heat and use and due to a possible change of dimension resulting from the wear of the valve and the block and also to a valve grinding operation.

It is an object further to provide a spacer unit which is particularly adapted to insulate the spring to a degree from the heat of the valve block and also to prevent circumferential creeping which increases the wear.

It is an object of the invention to provide a valve spacer ring shim which has radial grooves and radial ribs alternately spaced to provide increased cooling of the spring assembly without sacrificing the axial support needed at the spring base.

Other objects and features of the invention will be apparent in the following description and claims in which the principles of the invention are set forth together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
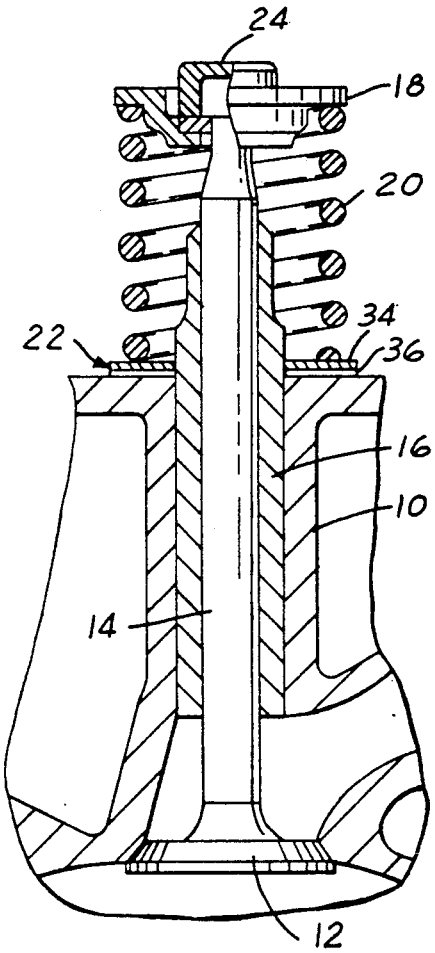
FIG. 1, a sectional view of an engine spring assembly showing the spacer shim in place.

REFERRING TO THE DRAWINGS, in FIG. 1, a motor block 10 has a valve 12 and a valve stem 14, the stem projecting upwardly out of the block through a sleeve 16. At the top of the valve stem 14 is a spring seat 18 suitably locked in place on the end of the valve stem and serving as a seat for the valve spring 20. A spacer shim 22 is shown in position around the sleeve 16.

A cam surface 24 serves in cooperation with a cam shaft to actuate the valve in a proper timing sequence.

The spacer shim 22 is formed on a metal sheet which is stamped in a stamping machine to have an outer circumference 30 and an inner hole 32. The ring can be stamped out as one operation or the ring may be shaped at the same time to provide alternate radial ribs 34 and radial grooves 36 on each top and bottom surface. The ribs and grooves are essentially trapezoidal in shape and they are spaced equally on each side of the ring. The spaces between the ribs on one side overlie the ribs on the other side in essentially the same circumferential dimension. The sides of the ribs and grooves are in a plane perpendicular to the plane of the ring.

Figure 2:
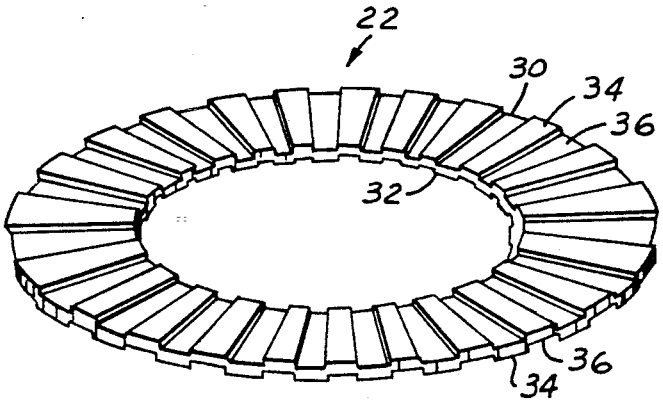
FIG. 2, a perspective view of the spacer shim.
Figure 3:
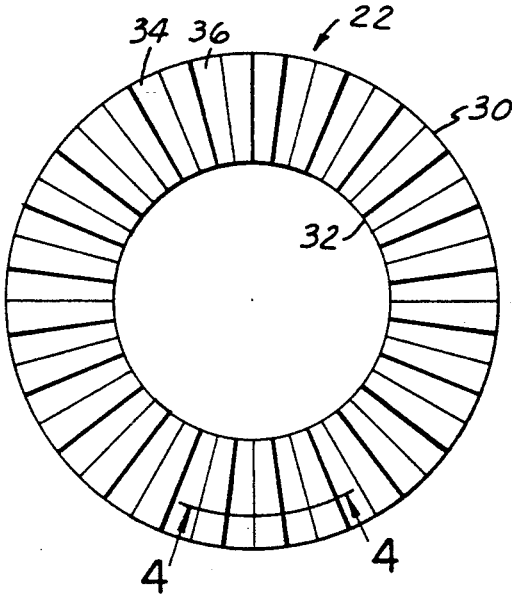
FIG. 3, a top elevation of the spacer shim.
Figure 4:
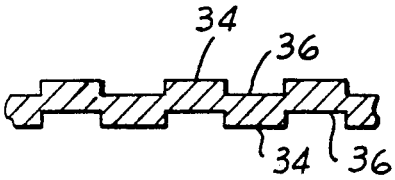
FIG. 4, a partial section on line 4—4 of FIG. 3.

Thus, as viewed in the sectional view of FIG. 4 and the perspective view of FIG. 2, the ribs on one side alternate in a continuous zigzag configuration circumferentially with ribs on the other side viewed from the edge of the ring. Similarly, the radial grooves on one side alternate in a zigzag configuration with the grooves on the other side. The depth of the grooves is less than one-half the total thickness of the ring.

With the present spacer ring shim, the valve spring must be removed to locate the spacer ring properly on the valve head. However, the alternating groove and rib construction makes it possible to have a greater overall axial dimension if this is desired. The axial dimension can be controlled by the thickness of the sheet stock used and the die design.

What is claimed is:

1. A spacer shim ring for altering valve spring tension in an internal combustion engine which comprises a metal ring having an open center to accommodate a valve stem and serving as a support for one end of a valve spring biased to close the valve, said ring lying in a plane and having a ribbed and grooved surface on each side, said ribs and said grooves being trapezoidal with curved ends and converging sides from a large outer end to a smaller inner end, the converging sides of said grooves and ribs lying in planes normal to the plane of the ring, and said grooves and ribs being equally spaced such that each has essentially equal circumferential dimensions, said ribs and grooves presenting a zigzag configuration viewed from the edge of the ring, the axial depth of the grooves being less than the total thickness of the ring.

* * * * *